US005461886A

United States Patent [19]

Kim et al.

[11] Patent Number: 5,461,886

[45] Date of Patent: Oct. 31, 1995

[54] LOW FREQUENCY VIBRATION TYPE WASHING MACHINE HAVING SHRINKABLE SHIELDING MEANS FOR PREVENTING CLOTHES FROM JAMMING

[75] Inventors: Jung C. Kim, Seoul; Dong Y. Oh; Gyu S. Choe, both of Kyungki-do; Kyung S. Hong, Inchon-Jikhalsi; Kyung H. Kim, Seoul; Joo H. Lee; Ha I. Lee, both of Kyungki-do; Kyeong B. Park, Seoul; Dong S. Gil, Seoul; Oh H. Kwon, Seoul; Byoung H. Kwon, Busan-Jikhalsi, all of Rep. of Korea

[73] Assignee: Goldstar Co., Ltd., Seoul, Rep. of Korea

[21] Appl. No.: 248,017

[22] Filed: May 24, 1994

[30] Foreign Application Priority Data

May 24, 1993 [KR] Rep. of Korea ..... 8953/1993

[51] Int. Cl.[6] ..... D06F 19/00

[52] U.S. Cl. ..... 68/3 SS; 68/131; 134/196; 366/333

[58] Field of Search ..... 68/3 SS, 133, 68/131; 134/184, 196, 197; 366/113, 108, 127, 267, 268, 332, 333, 334, 335, 275

[56] References Cited

U.S. PATENT DOCUMENTS 2,303,940 12/1942 Kuhn ..... 69/355

3,010,303 11/1961 Bochan ..... 68/355 X

FOREIGN PATENT DOCUMENTS 691392 10/1930 France ..... 60/355

845789 8/1952 Germany ..... 68/355

853150 10/1952 Germany ..... 68/355

672238 5/1952 United Kingdom ..... 68/355

*Primary Examiner*—Frankie L. Stinson

*Attorney, Agent, or Firm*—Finnegan, Henderson, Farabow, Garrett & Dunner

[57] ABSTRACT

A low frequency vibration type washing machine has a shrinkable shielder for prevention of clothes jamming in the gap between the low frequency vibrating disc and the inner bottom of the washing tub from the outside. The washing machine includes the washing tub and a vibrating disc placed in the washing tub for causing resonance phenomena in a multi-phase washing medium received in the washing tub. The shrinkable shielder is placed in the gap such that it shields the gap from the outside. The shielder totally or partially shields the gap and is made of rubber or sponge. The shielder may be a tube type shielder placed in the gap at a lower edge of the vibrating disc. Alternatively, the shielder may be a spring type shielder. As a further alternative, the shielder may be a flexible thin film annularly placed in the gap at a lower edge of the vibrating disc. The tube type shielder is charged with gas or liquid.

8 Claims, 2 Drawing Sheets

LOW FREQUENCY VIBRATION TYPE WASHING MACHINE HAVING SHRINKABLE SHIELDING MEANS FOR PREVENTING CLOTHES FROM JAMMING

BACKGROUND OF THE INVENTION

1. Field of the Invention

The present invention relates in general to automatic washing machines using low frequency vibration in clothes washing and, more particularly, to an improved structure in such washing machines for prevention of jamming of clothes in a gap between a low frequency vibrating disc and the inner bottom of a washing tub.

2. Description of the Prior Art

In order to wash clothes in a conventional automatic washing machine using low frequency vibration, a low frequency vibrating disc placed in a washing tub generates a specified low frequency vibration which causes resonance phenomena in a multi-phase washing medium in the washing tub. Here, the multi-phase washing medium consists of water, detergent and air. The level of low frequency is specified in accordance with the shape of the washing tub, the shape of the vibrating disc and the mixing ratio of the multi-phase washing medium.

In the above washing machine, the desired mechanical washing effect is achieved by the micro air bubbles generated by cavitation of the vibrating disc or nonlinear vibration. Both the cavitation and the nonlinear vibration are generated in the multi-phase medium at the same time as the generation of the resonance phenomena. The mechanical washing effect caused by the cavitation or the nonlinear vibration cooperates with a chemical washing effect caused by the detergent in the washing medium, thus to achieve the desired washing effect.

With reference to FIG. 1, there is shown a typical automatic washing machine using the low frequency vibration. The washing machine generally comprises a washing tub 1 receiving a multi-phase washing medium therein, a low frequency vibrating disc 2 causing the resonance phenomena in the washing medium and a disc drive unit 3. The vibrating disc 2 is placed in the washing tub 1 and driven by the drive force of the drive unit 3.

It has been noted that the above washing machine is profitable from the viewpoint of energy savings since it requires minimum energy for generation of the resonance phenomena in the multi-phase washing medium in the washing tub 1. However, this washing machine has a problem in that some of the clothes are often jammed in a gap between the vibrating disc 2 and the inner bottom of the washing tub 1. Such a jamming of the clothes causes damage to the jammed clothes. The jammed clothes also prevent other clothes from circulating in the washing medium in the tub 1, thus deteriorating the washing effect of the washing machine.

SUMMARY OF THE INVENTION

It is, therefore, an object of the present invention to provide a low frequency vibration type washing machine having shrinkable shielding means for prevention of the jamming in which the aforementioned problem of the conventional washing machine can be overcome and whose shielding means totally or partially shields the gap between the low frequency vibrating disc and the tub bottom from the outside.

In order to accomplish the above object, a low frequency vibration type washing machine in accordance with an embodiment of the present invention comprises: a washing tub receiving a multi-phase washing medium therein; a vibrating disc placed in the washing tub for causing resonance phenomena in the multi-phase washing medium, the disc being driven by a drive unit; and shrinkable shielding means for prevention of clothes jamming in a gap between an inner bottom of the washing tub and the vibrating disc, the shielding means being placed in the gap such that it shields the gap from the outside.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
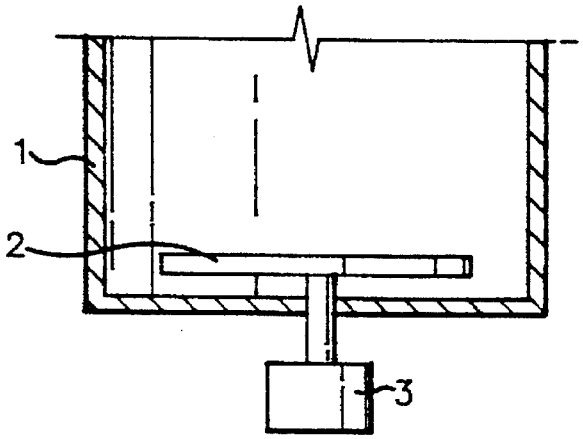
FIG. 1 PRIOR ART
FIG. 1 is a sectional view of a conventional washing machine using a low frequency vibration in the washing operation.
Figure 2:
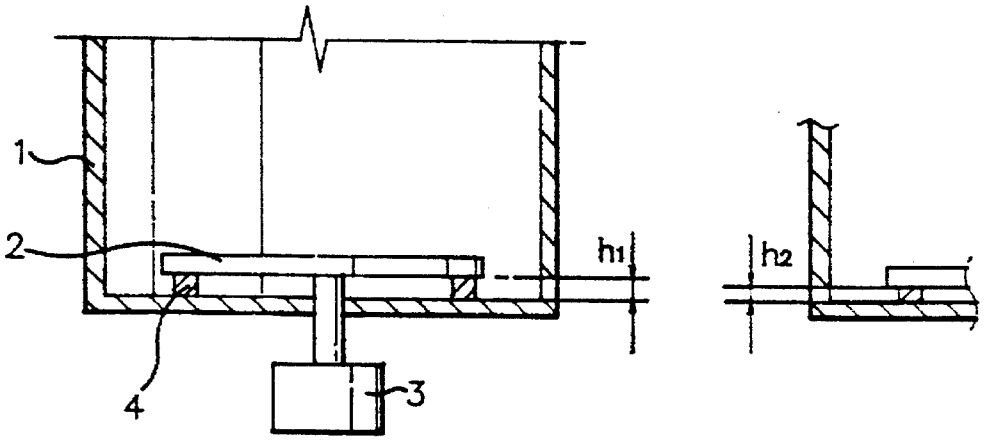
FIG. 2 is a sectional view of a low frequency vibration type washing machine having shrinkable shielding means in accordance with an embodiment of the present invention.

With reference to FIG. 2, there is shown in a sectional view a low frequency vibration type washing machine having shrinkable shielding means in accordance with a first embodiment of the present invention. In this first embodiment, the shrinkable shielding means for prevention of clothes jamming comprises a shrinkable shielder 4 which is annularly placed in the gap between a low frequency vibrating disc 2 and the inner bottom of a washing tub 1 at the lower edge of the disc 2. This shielder 4 thus shields the inside gap from the outside. This shrinkable shielder 4 may be made of rubber, sponge, an air tube or a spring.

Here, the height of the shrinkable shielder 4 is equal to the distance from the inner bottom of the washing tub 1 to the maximum vibrating position of the disc 2. That is, when letting the distance from the inner bottom of the tub 1 to the maximum vibrating position be $h_1$ and letting the distance from the inner bottom of the tub 1 to the minimum vibrating position be $h_2$ as represented in FIG. 2, the height of the shrinkable shielder 4 will be set as $h_1$. Of course, the shrinkable shielder 4 should be designed such that it can be elastically shrunk and extended in the vibration stroke $h_1-h_2$ of the vibrating disc 2.

In the present invention, the shrinkable shielder 4 is fixed to either the inner bottom of the washing tub 1 or the lower surface of the vibrating disc 2.

In addition, the shrinkable shielder 4 may be a closed ring which can totally shield the inside gap between the inner bottom of the tub 1 and the disc 2 from the outside. Alternatively, the shielder 4 may comprise a plurality of unit pieces which are annularly placed in the gap at the lower edge of the disc 2 such that the pieces are spaced out at regular intervals. When the shielder 4 comprises the plurality of unit pieces, the shielder 4 partially shields the gap from the outside and, at the same time, the regular intervals between the pieces should prevent the clothes from passing therethrough.

When the shrinkable shielder 4 is an air tube type shielder, it may be charged with gas or liquid.

Figure 3:
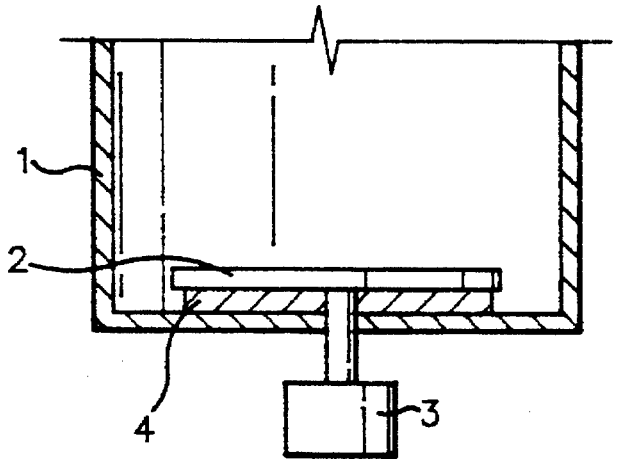
FIG. 3 is a view corresponding to FIG. 2, but showing another embodiment of the present invention.

Turning to FIG. 3, there is shown a low frequency vibration type washing machine having shrinkable shielding means in accordance with a second embodiment of the present invention. In this second embodiment, the shrinkable shielding means comprises a disc type shielder 4*a* having a mounting hole at its center. This disc type shielder 4*a* is fitted over the drive shaft of a drive unit 3 in the gap between the inner bottom of the tub 1 and the vibrating disc 2. The drive shaft is coupled to the disc 2 at its distal end, thus to transmit the drive force of the drive unit 3 to the disc 2. In the same manner as described for the first embodiment, the disc type shielder 4*a* of this second embodiment is made of rubber, sponge, an air tube or a spring.

Figure 4:
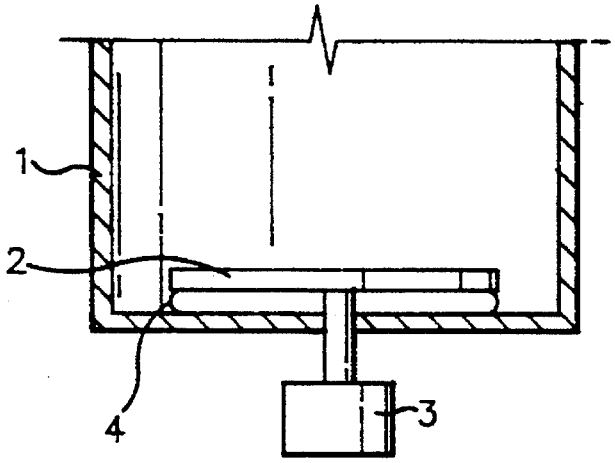
FIG. 4 is a view corresponding to FIG. 2, but showing still another embodiment of the present invention.

FIG. 4 shows a low frequency vibration type washing machine having shrinkable shielding means in accordance with a third embodiment of the present invention. In this third embodiment, the shielding means comprises a flexible thin film 4*b* which is annularly placed in the gap between the inner bottom of the washing tub 1 and the disc 2 at the lower edge of the disc 2 such that it shields the inside gap from the outside.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A low frequency vibration type washing machine comprising:

a washing tub for receiving a multi-phase washing medium therein, said washing tub including a fixed bottom wall having an inner surface;

a shaft extending through said bottom wall and having an upper end and a lower end connected to a drive unit mounted below said bottom wall;

a rigid vibrating disc having a lower side and operating in said washing tub to cause a resonance phenomena in said multi-phase washing medium, said disc connected to the upper end of the shaft to be driven by said drive unit, the lower side of the vibrating disc disposed in uniformly spaced relation to the inner surface to create a gap; and shrinkable shielding means disposed in the gap to prevent clothes from becoming jammed in the gap during a clothes washing operation.

2. The low frequency vibration type washing machine according to claim 1, wherein said shrinkable shielding means totally shields said gap from the outside.

3. The low frequency vibration type washing machine according to claim 1, wherein said shrinkable shielding means comprises a plurality of unit pieces which are spaced out at regular intervals and partially shield said gap from the outside.

4. The low frequency vibration type washing machine according to any one of claims 1 to 3, wherein said shrinkable shielding means is made of rubber or sponge.

5. The low frequency vibration type washing machine according to any one of claims 1 to 3, wherein said shrinkable shielding means is a tube type shielder placed in said gap at a lower edge of said vibrating disc.

6. The low frequency vibration type washing machine according to claim 5, wherein said tube type shielder is charged with gas or liquid.

7. The low frequency vibration type washing machine according to any one of claims 1 to 3, wherein said shrinkable shielding means is a spring type shielder.

8. The low frequency vibration type washing machine according to any one of claims 1 to 3, wherein said shrinkable shielding means is a flexible thin film annularly placed in said gap at a lower edge of said vibrating disc.

* * * * *